US005375635A

United States Patent [19]

Tice

[11] Patent Number: 5,375,635

[45] Date of Patent: Dec. 27, 1994

[54] TAMPER EVIDENT HEAD FOR PRESSURIZED TANKS INCLUDING A LOCKOUT DEVICE

[75] Inventor: Robert J. Tice, Stockholm, N.J.

[73] Assignee: Roussel-Uclaf, France

[21] Appl. No.: 200,209

[22] Filed: Feb. 23, 1994

[51] Int. Cl.[5] ..... B65D 55/00

[52] U.S. Cl. ..... 141/94; 141/18; 141/329; 141/367; 141/285; 215/230; 215/203; 222/147

[58] Field of Search ..... 141/18, 21, 29, 94, 141/285, 289, 302, 305, 329, 367, 368, 379; 222/147; 215/26, 203, 230, 309; 220/253

[56] References Cited

U.S. PATENT DOCUMENTS 4,446,979 5/1984 Gach et al. ..... 215/203

4,674,641 6/1987 Rusinyak ..... 215/230

*Primary Examiner*—J. Casimer Jacyna

*Attorney, Agent, or Firm*—Bierman and Muserlian

[57] ABSTRACT

An apparatus for preventing the refilling and reuse of a container after it has dispensed its original contents without being evident of tampering. Refilling is prevented by a lockout device having an armed position and a closed position. The lockout device is in the armed position until attached to a filling apparatus. The pressure caused by a carrier dispensed from the apparatus through the lockout device causes the lockout device to spin to a closed and locked position. In the closed and locked position, the container cannot be refilled. A seal is provided above the lockout device and the device can only be rearmed and container refilled after the seal has been removed.

9 Claims, 3 Drawing Sheets

TAMPER EVIDENT HEAD FOR PRESSURIZED TANKS INCLUDING A LOCKOUT DEVICE

The present invention is directed to a head assembly for a refillable tank adapted to be charged with an active ingredient and a pressurized carrier. More specifically, the invention is directed to a head for a pressurized, refillable tank which is tamper resistant and prevents the unauthorized recharging of materials into the tank. To accomplish the foregoing, a head is used which is supplied with a lockout device covered with a seal, which prevents refilling of the tank to be attached without damaging the seal and/or causing other evidence of tampering.

BACKGROUND OF THE INVENTION

Although applicable to any system in which a pressurized tank is charged with an active ingredient and carrier, in which unauthorized refilling of the tank is to be avoided, the inventive device is specifically useful in the field of pesticide dispensing systems, and is described in that context below.

Pesticide dispensing systems of the type to which the inventive lockout device is directed are described in, for example, U.S. Pat. Nos. 5,020,689 and 5,150,822. In the systems described therein, an active ingredient, such as a pesticide or fumigant, is placed in a sample cylinder, and a pressurized carrier which acts both as a solvent and propellent is subsequently introduced from a carrier source. This solvent/propellent expands in the tank to adopt a liquid phase and a gaseous phase. The liquid phase serves to absorb the active ingredient, while the gaseous phase serves to propel the borne active ingredient out of the apparatus through a dispensing outlet where further expansion takes place and whereby the active ingredient is dispersed in a fog or a mist. Such systems are particularly suitable for the spraying of insecticides where a metered amount of active ingredients is to be dispersed, or for exhausting a total supply of active ingredient.

After exhaustion, the tanks are separated from the dispersing apparatus, and sent for recharging. In the field of pesticides, stringent government control is placed on companies authorized to recharge such tanks and strict precautions must be taken to ensure that unsuitable materials are not placed in the tank. Because of the excellent solvent action of the propellent, the inside of the tanks are extremely clean when returned to the recharging station by the user. In fact, when an empty tank is received, it will contain far less than 1% of the active ingredient with which it was originally charged. Thus, it is not necessary to wash the tanks and, if there were not concerns with contamination from outside sources, the tanks could simply be attached to the refilling apparatus and recharged.

Unfortunately, with the common tank assemblies presently in use, it is not possible to fully verify that no material other than what was originally charged into the tank, has been added. Therefore, due to government regulation, it is necessary to disassemble the head assembly from the tank, and wash it. This procedure is both costly and time consuming.

BRIEF DESCRIPTION OF THE INVENTION

In view of the foregoing, it is an object of the present invention to provide a tank head which prevents access to the interior of the tank for refilling, without clear evidence of tampering. The invention allows the refilling station to verify that no contaminates have been introduced into the tank sent for initial charging, or previous recharging. Due to the verification that tampering has occurred supplied by the present inventive head, the refilling station is able to recharge the tank, without washing, except in case where some evidence of tampering is present.

Other objects and features of the present invention will become apparent from the following detailed description considered in conjunction with the accompanying drawings.

DETAILED DESCRIPTION OF THE INVENTION

Figure 1:
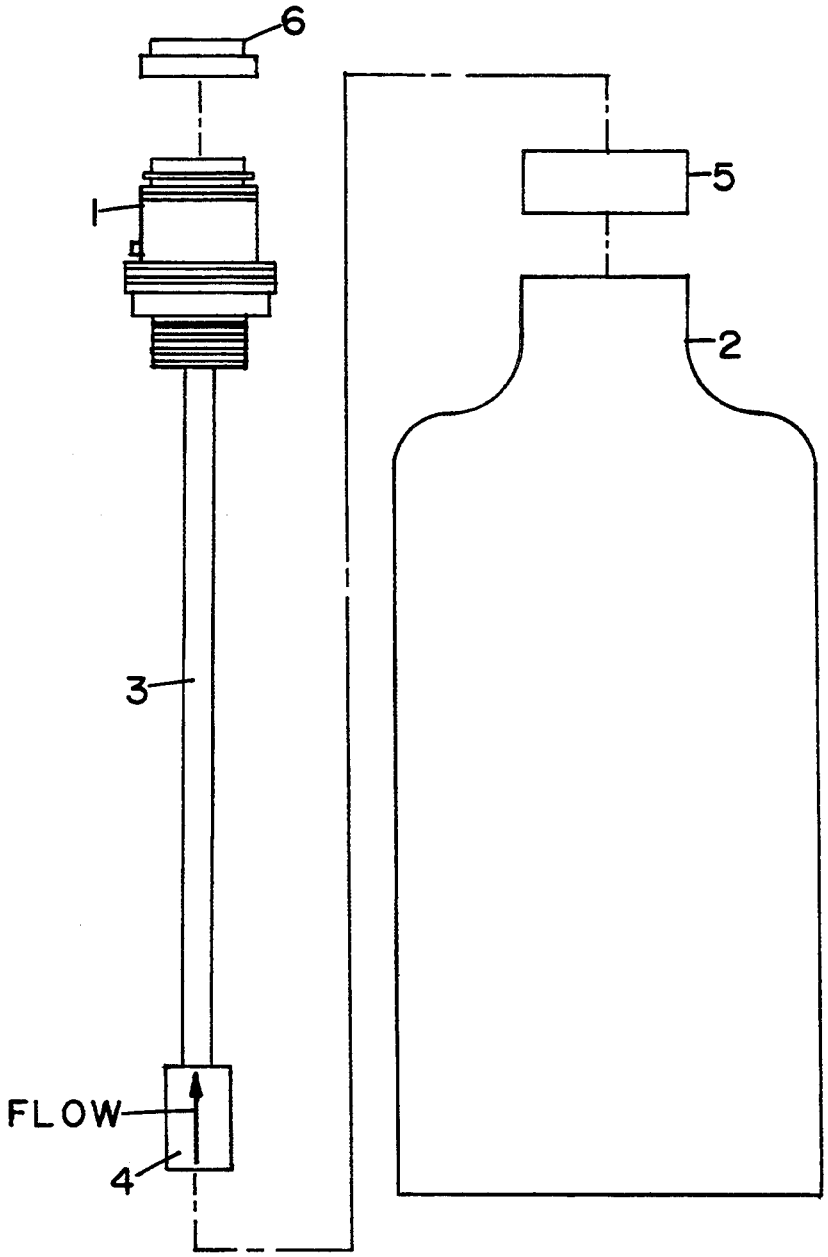
FIG. 1 is a side view of the tank system and inventive head assembly illustrating the manner in which the inventive head would be assembled on the tank.

FIG. 1 illustrates the manner in which the inventive head 1 with the lockout system works in combination with tank 2. Initially, a dosage of active ingredient is supplied to tank 2. Dip tube 3, preferably supplied with check valve 4 is attached to head assembly 1 which is then attached to tank 2. Tamper evident tape 5 is applied to the union area between head 1 and tank 2, and tamper evident cap is crimped on to the upper portion of head 1. In this state, the tank 2 is ready to be charged with a pressurized carrier.

The pressurized carrier acts both as a solvent and as a propellent. As such, the active ingredient must be soluble in the carrier. For pesticides, fumigants, and the like, carbon dioxide is a commonly used solvent/propellent. During charging, the solvent/propellent expands to adopt a liquid phase and gaseous phase. The liquid phase serves to absorb the active ingredient, and the gaseous phase serves to propel the borne active ingredient out of the apparatus through a dispensing outlet where further expansion takes place and the active ingredient is dispersed in a fog or mist.

Figure 2:
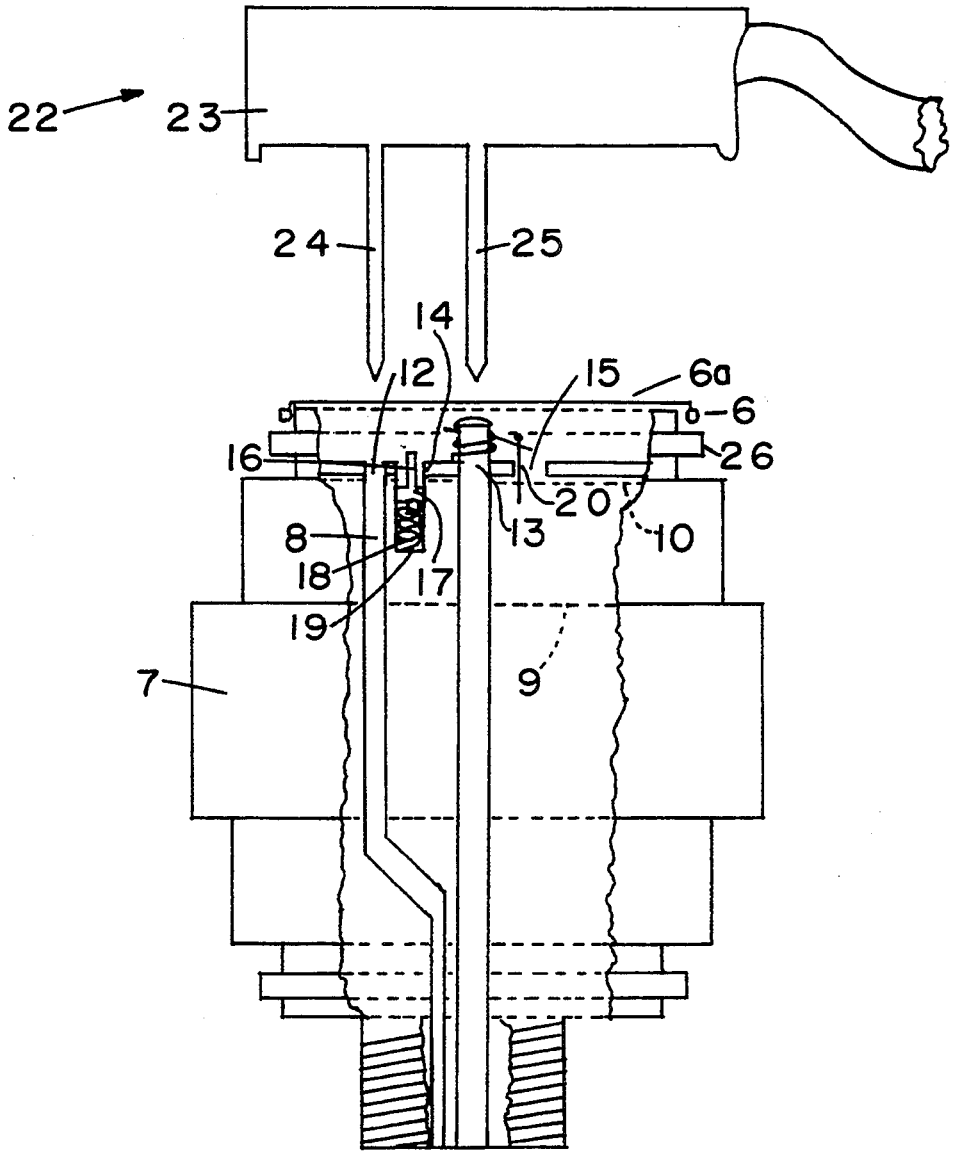
FIG. 2 is a side view, partially cut away of the inventive head assembly in an armed position in which it is in condition to allow for refilling of the tank. Also shown is the refill assembly which is, in turn, attached to a pressurized carrier supply (not shown).

FIG. 2 illustrates head assembly 1 in an armed position, a position in which the tank to which head assembly 1 is connected can be charged. Head assembly 1 comprises main body 7 adapted to attach to an opening in tank 2 which includes at least 2 passage ways formed therethrough to an interior of tank 2, these passage ways including inlet 8 for charging the tank and outlet 9 through which a stream of active ingredient in pressurized carrier can be expelled from the tank.

Positioned on upper face 10 of main body 7, distant from tank 2, is provided a lockout system adapted to prevent unauthorized recharging of the tank. This lockout system comprises lockout disk 11 provided with a first opening 12 corresponding in position to inlet 8, second opening 13 corresponding in position to outlet 9, third opening 14 and raceway 15.

A piston assembly comprising piston head 16 having shoulder portion 17 and piston spring 18 are provided in piston port 19 formed in main body 7. Piston head 16, forced by piston spring 18, extends from main body 7 through third opening 14 in lockout disk 11 shoulder portion 17 preventing piston head 16 from passing completely through third opening 14.

Stop pin 20 extends from upper face 10 through raceway 15 of lockout disk 11. Spring member 21 impinges upon stop pin 20 to urge rotation of lockout disk 11. Rotation is initially, in the armed position, prevented by piston head 16.

Over lockout disk 11 is provided a tamper evident cap 6, formed of a puncturable material and further comprising crimp ring 6*a*. Once crimp ring 6*a* is crimped onto main body 7, tamper evident cap cannot be removed without causing damage thereto; this damage would provide evidence that tampering has occurred.

Although not part of the invention, also shown in FIG. 2 is ejector 22 used to provide a charge of pressurized carrier to tank 2. Ejector 22 is connected to a source of pressurized carrier material (not shown) and comprises ejector body 23 adapted to fit over an upper portion of main body 7, and first probe 24 which aligns with first opening 12 in lockout disk 11 and inlet 8. Preferably, a second probe will be provided in a position corresponding to second opening 13 in lockout disk 11 and outlet 9 so that when the carrier is supplied, a pressure differential is established. The manner in which this is accomplished and the benefits of this type of ejector are described in U.S. Pat. No. 5,150,822, described infra.

Upper face 10 of main body 7 is recessed within side wall 26. This allows lockout disk 11 to be held in place by a spring clip, spring wire, or the like or can be held in place by the cap.

Upon coupling with the pressurized carrier, first probe 24 of ejector 22 punctures cap 6 and engages inlet 8 of main body 7 through first opening 12 in lockout disk 11. If present, at the same time, second probe 25 punctures cap 6 and engages inlet 8 through a second opening 13. Pressure from the pressurized carrier formed in a chamber defined by ejector body 23, side walls 26 and lockout disk 11 causes the depression of piston head 16 whereby lockout disk 11 rotates under the urging of spring member 21, until it impinges on first probe 24. At that point, piston head 16 is positioned under lockout disk 11, and is no longer capable of impeding rotation. Preferably, third opening 14 is formed to have an elongated shape to aid in the release of lockout disk 11 by piston head 16.

Upon completion of charging, first probe 24 and second probe 25 are withdrawn. Upon withdrawal of first probe 24, lockout disk 11 further rotates due to urging from spring member 21 until an end of raceway 15 contacts stop pin 20. At that position, first opening 12 in lock out disk 11 aligns with piston head 16 which extends through first opening 12 under the urging of piston spring 18. Piston head 16 thereby locks lockout disk 11 at a position in which inlet 8 of main body 7 is covered.

Upon withdrawal of first probe 24 and second probe 25, only two puncture holes corresponding with the position of the probes will have been formed in cap 6. Due to rotation of lockout disk 11, access to the interior of tank 2 through the puncture holes formed in cap 6 will no longer be possible. The lockout system cannot be placed back in the armed position without substantial damage being done to cap 11, and such damage will provide ample evidence of tampering to alert the refilling station that an unauthorized recharging has occurred, and appropriate action can be taken.

Figure 3:
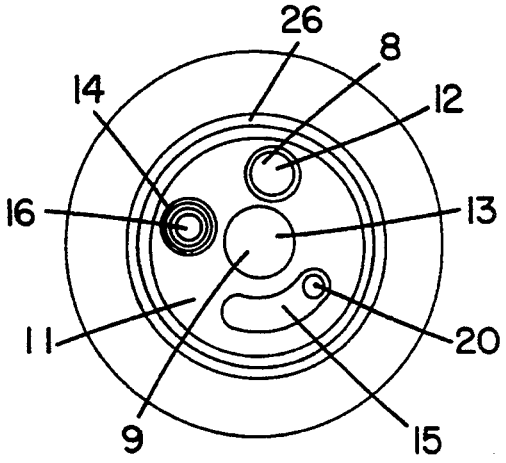
FIG. 3 is a top view of the inventive head assembly and lockout system in the armed position in which access to the interior of the tank is provided.
Figure 4:
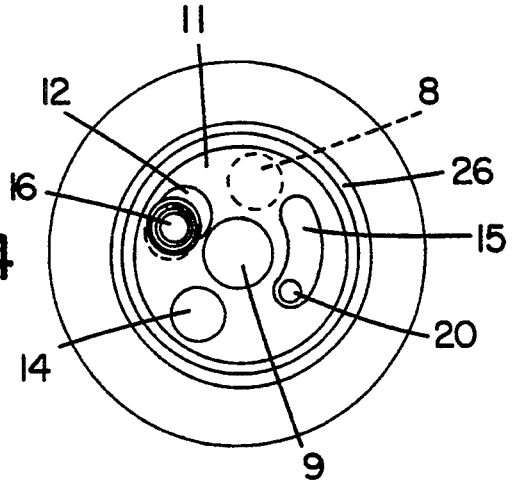
FIG. 4 is a top view of the lockout system illustrating said system in a locked mode.
Figure 5:
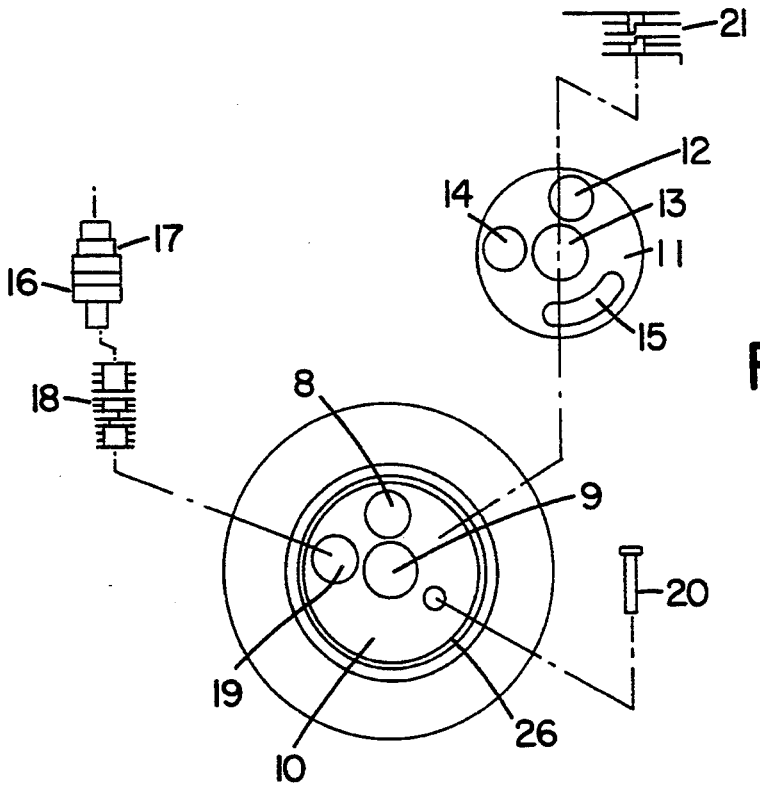
FIG. 5 is an exploded view of the components of the lockout device.

The interaction of the various parts of the lockout system of the invention are clearly illustrated in FIGS. 3 to 5. FIG. 3 is a top view of the inventive lockout device in the armed position. In the armed position, first opening 12 and third opening 14 in lockout disk 11 correspond in position to inlet 8 and piston port 19 formed in main body 7 respectively. Piston head 16 extends through opening 14 preventing rotation of lockout disk 11.

FIG. 4 illustrates the inventive lockout position in the sprung position after charging and the withdrawal of the ejector probes. In this position, due to the rotation caused by the spring force of spring member 21, inlet 8 no longer corresponds with the position of any opening in lockout disk 11 and is covered thereby. First opening 12 corresponds in position to piston port 19 and due to the urging of piston spring 18, piston head 16 extends there-through. Further rotation is stopped by the impinging of stop pin 20 against the second end of raceway 15, and counter rotation is impeded by the extending piston head 16. The lockout device can only be rearmed by depressing piston head 16 and rotating lockout disk 11 against the force of spring member 21. Such cannot be accomplished through the holes formed by the probes in tamper cap 6, without serious and immediate evident damage being done thereto. FIG. 5 illustrates an explored view of the various components of the claimed lockout device.

While only the fundamental novel features of the invention as applied to a preferred embodiment thereof have been shown and described, it is understood that various omissions, substitutions and changes in the form and details of the device illustrated and in its operation may be made by those skilled in the art without departing from the spirit of the invention. It is therefore the intention of the Applicant that the invention be limited only as indicated by the scope of the claims appended hereto.

I claim:

1. A head assembly for use with a tank charged with an active ingredient and a pressurized carrier, said tank being capable of being refilled after an initial charge is used, said head assembly comprising;

a main body adapted to an opening in said tank, said body having at least two passage-ways formed therethrough to the interior of said tank, including an inlet for charging said tank which contains said active ingredient with said pressurized carrier and an outlet through which a stream of said active ingredient in said pressurized carrier can be expelled from said tank, and a lockout system adapted to prevent unauthorized recharging of said tank, said lockout system comprising;

a lockout disk positioned on an upper face of said main body distant from said tank, said disk being provided with a first opening and a second opening corresponding to said inlet and outlet of said main body respectively, a third opening and a raceway and a piston assembly comprising a piston head having at least one shoulder portion and a piston spring, said piston assembly being provided in a piston port form in said main body, said piston head being forced by said piston spring to extend from said body through said third opening in said lockout disk, said shoulder portion preventing said piston head from passing completely through said third opening, a stop pin extending from said upper face of said main body through said raceway of said lockout disk, a spring member which impinges upon said stop pin to urge rotation of said lockout disk, said rotation being initially prevented by said piston head, and a cap having an upper portion formed of a puncturable material which is adapted to cover said upper face of said main body and said lockout system, and be crimped onto said main body wherein, upon charging with said pressurized carrier, a probe of a pressurized filling device punctures said cap and engages said inlet of said main body, through said first opening in said lockout disk, pressure from said pressurized carrier further depressing said piston head whereby said lockout disk rotates until it impinges on said probe and, upon completion of charging, said probe is withdrawn and said lockout disk further rotates due to urging from said spring member until an end of said raceway contacts said stop pin at which point said first opening in said lockout disk aligns with said piston head whereby said piston head extends under force of said piston spring into said first opening locking said lockout disk in a position in which said inlet of said main body is covered.

2. The assembly of claim 1 wherein said cap is adapted to display evidence of tampering if a probe is inserted at any position other than a position which corresponds to said inlet, or if said crimp of said cap is disturbed.

3. The assembly of claim 1 wherein said outlet is connected to a dip tube extending into said tank, said dip tube being provided with a valve which prevents filling of said tank through said outlet.

4. The assembly of claim 1 wherein said cap further acts as a gasket between said assembly and said filling device.

5. The assembly of claim 1 wherein the union between said main body and said tank is covered with tamper resistant tape.

6. The assembly of claim 1 wherein said active ingredient is a pesticide.

7. The assembly of claim 6 wherein said pressurized carrier is a solvent into which said pesticide dissolves.

8. The assembly of claim 7 wherein said pressurized carrier is carbon dioxide.

9. The assembly of claim 1 wherein upon charging, a second probe of said pressurized filling device punctures said cap and engages said outlet of said main body to form a pressure differential.

* * * * *